US005159963A

United States Patent [19]

Paajanen

[11] Patent Number: 5,159,963

[45] Date of Patent: Nov. 3, 1992

[54] PRESSURE BAR FOR VENEER SLICING MACHINES

[76] Inventor: Alpo Paajanen, Reitkalli, Finland, 49520

[21] Appl. No.: 675,555

[22] Filed: Mar. 26, 1991

[51] Int. Cl.[5] ..... B27C 7/00

[52] U.S. Cl. ..... 144/213; 144/209 R; 144/365

[58] Field of Search ..... 144/209 R, 213, 213 A, 144/36 S

[56] References Cited

U.S. PATENT DOCUMENTS 528,120 10/1894 Brown ..... 144/213

3,851,844 3/1969 Carlton ..... 144/213

4,222,421 9/1980 Walser et al. ..... 144/213

*Primary Examiner*—W. Donald Bray

*Attorney, Agent, or Firm*—Darby & Darby

[57] ABSTRACT

A veneer slicing machine having a cutting knife and a pressure bar spaced from the knife having a face for contacting the wood for creating pressure on the wood to be sliced, the region of the pressure bar before the face on the entrance side of the knife having a concave portion and the region of the bar past the point of contact of the face with the wood on the exit side also being concave, the pressure bar wood contacting face being convex.

6 Claims, 1 Drawing Sheet

PRESSURE BAR FOR VENEER SLICING MACHINES

BACKGROUND OF THE INVENTION

The invention relates to a pressure bar for veneer slicing machines.

Such bars serve in veneer slicing machines as pressure and hold-up tool in cooperation with the actual veneer cutter and have in general the function, besides providing the required slicing counterpressure, to make it possible to avoid fissuring by compacting the wood on the top side of the veneer being formed. Until now, the pressure bar has customarily been made with a relatively sharp edge, which makes linear contact with the veneer. This sharp edge produces the necessary force to press the pressure zone or slicing region against the knife. This force is relatively great and extends, as has been mentioned, practically linearly over the width of the wood. Further, in the known pressure bars the free face extending back from the edge is flat, so that the press-on area has essentially the form of a wedge. A disadvantage with the known pressure bars, besides the high linear press-on force, is that veneer slicing tools constructed with them tend to produce relatively long splinters or chips and, because of them, to clogging in the cutting edge region.

OBJECT OF THE INVENTION

It is the object of the invention to provide a pressure bar for veneer slicing machines with which improved working conditions in veneer slicing can be obtained. In particular a better force distribution is to be brought about, and the danger of clogging by splinters or short chips is to be reduced or avoided.

BRIEF DESCRIPTION OF THE INVENTION

According to the invention, this problem is solved in that the contact region of the pressure bar that generates the press-on pressure against the wood is formed as a moderately curved, convex pressure face. Thus a longer pressure zone in the passage of the wood is obtained, as the contact region between veneer and pressure bar is greater, and consequently less force is needed for holding the working and pressure zone against the knife.

According to an advantageous embodiment of the invention, the pressure face may be disposed raised relative to the part of the pressure bar present before it on the entrance side, so that especially favorable force/-pressure conditions result.

Preferably the region of the pressure bar lying before the pressure face on the entrance side may be designed as a concave free face. This serves to prevent relatively small splinters, chips or shavings which collect on the front side from clogging the knife region, so that the cutting process can proceed continuously and unimpaired over a prolonged period. This is a major improvement over the wedge-shaped form of the pressure bar of the prior art, where such splinters or chips are pressed against the veneer and over time seriously impair the slicing process and ultimately cause it to stop. Also it has been found that by this advantageous design according to the invention the splinters or chips become shorter and thus can pass through and leave the pressure region more easily, so that they do not impede the slicing process.

BRIEF DESCRIPTION OF THE DRAWINGS

Additional advantages and specific possible embodiments of the invention will become evident from the following description of the forms of realization represented in the schematic drawing, in which.

DETAILED DESCRIPTION OF THE INVENTION

Figure 1:
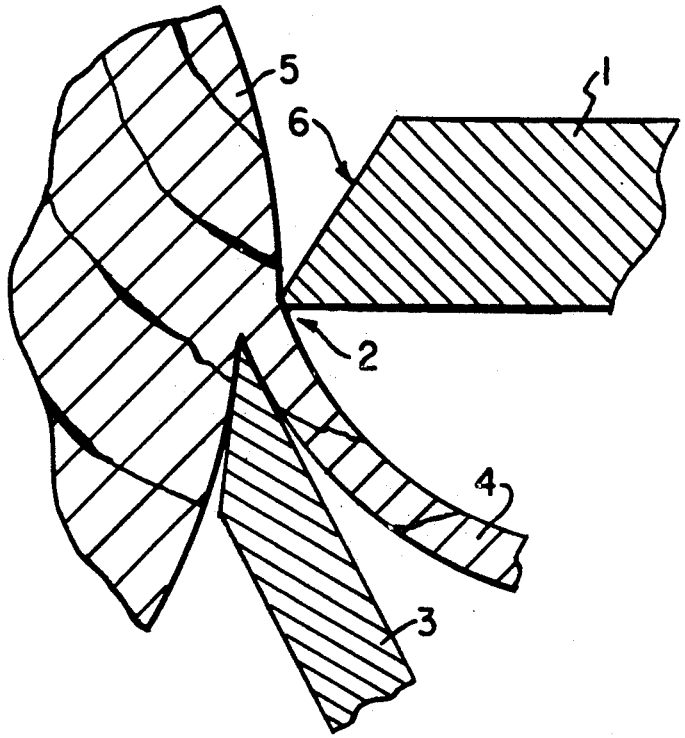
FIG. 1 (PRIOR ART)
FIG. 1 shows in transverse section the arrangement and design of the pressure bar and slicing knife according to prior art, and FIG. 2 in similar transverse section, a form of realization of the pressure bar according to the present invention.
Figure 2:
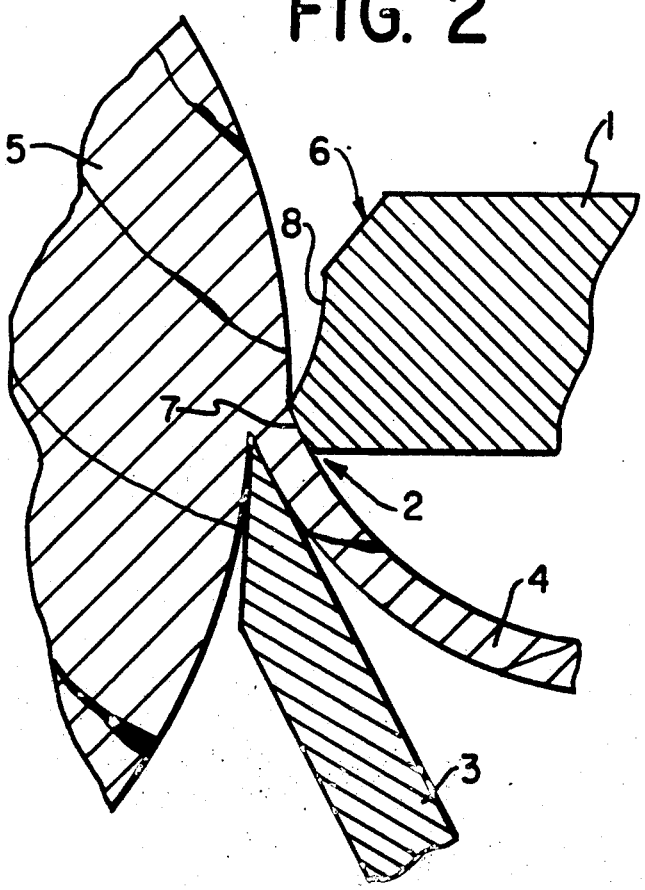

In FIG. 1 is seen a conventional pressure bar 1 of a veneer slicing machine with a contact region 2, formed as a relatively sharp edge, for producing the necessary press-on force onto a piece of wood 5 to be made into a veneer 4 by means of a veneer cutting knife 3. As can be seen from the representation in transvers section, the front side 6 of the pressure bar 1, located on the entrance side of the wood 5 to be sliced, is formed as a flat face, so that the pressure bar 1 is wedge-shaped in this region.

As distinguished from this conventional form of a pressure bar, in a pressure bar 1 according to the invention the contact region 2 for the generation of the necessary pressing force is designed as a moderately curved, convexly arched face 7. Here, instead of the flat front side 6 of the prior art, the front side is provided with a concave free face 8, whereby at the same time a raised arrangement of the convex contact region 2 results. The advantages of this design according to the invention reside in a larger contact area, a longer contact path with the wood as the latter passes through, and also in that the danger of clogging in the knife region due to splinters, chips or shavings is reduced and moreover the latter, if they form, are shorter than in conventional arrangements.

I claim:

1. A veneer slicing machine comprising:

a veneer cutting knife;

a pressure bar spaced from the knife for creating the pressure on the wood to be sliced, said pressure bar having a face for contacting the wood, the region of the pressure bar before said face on its entrance side having a concave face.

2. A veneer slicing machine as in claim 1 wherein the pressure bar wood contacting face is convex.

3. A veneer slicing machine comprising:

a veneer cutting knife;

a pressure bar spaced from the knife for creating the pressure on the wood to be sliced, said pressure bar having a face for contacting the wood, the region of the pressure bar before said pressure bar face on its entrace side having a concave free face and said face is disposed raised relative to the part of said pressure bar before it on the entrance side.

4. A veneer slicing machine as in claim 3 wherein the pressure bar wood contacting face is convex.

5. A veneer slicing knife as in claim 2 wherein the exit region of the pressure bar located past the point of contact of the pressure bar face with the wood is a concave free face.

6. A veneer slicing knife as in claim 4 wherein the exit region of the pressure bar located past the point of contact of the pressure bar face with the wood is a concave free face.

* * * * *